US005738597A

United States Patent [19]

Sullivan et al.

[11] Patent Number: 5,738,597

[45] Date of Patent: Apr. 14, 1998

[54] GOLF BALL

[75] Inventors: Michael J. Sullivan, Chicopee; Dennis Nesbitt, Westfield; Mark Binette, Ludlow, all of Mass.

[73] Assignee: Lisco, Inc., Tampa, Fla.

[21] Appl. No.: 782,199

[22] Filed: Jan. 10, 1997

Related U.S. Application Data

[60] Continuation-in-part of Ser. No. 530,851, Sep. 20, 1995, which is a division of Ser. No. 171,956, Dec. 22, 1993, Pat. No. 5,503,397, which is a continuation of Ser. No. 8,198, Jan. 25, 1993, abandoned.

[51] Int. Cl.[6] ..... A63B 37/06; A63B 37/12

[52] U.S. Cl. ..... 473/377; 473/378

[58] Field of Search ..... 473/377, 378

[56] References Cited

U.S. PATENT DOCUMENTS

| | | | |
|---|---|---|---|
| 2,805,072 | 9/1957 | Smith | 473/378 |
| 3,362,937 | 1/1968 | Kent et al. | 473/378 X |
| 3,819,768 | 6/1974 | Molitor . | |
| 4,201,384 | 5/1980 | Barber . | |
| 5,273,287 | 12/1993 | Molitor et al. . | |
| 5,503,379 | 4/1996 | Michalik et al. . | |

FOREIGN PATENT DOCUMENTS

| | | |
|---|---|---|
| 192618 | 1/1980 | New Zealand . |

*Primary Examiner*—George J. Marlo

*Attorney, Agent, or Firm*—Donald R. Bahr; Laubscher & Laubscher

[57] ABSTRACT

A golf ball of improved playing characteristics weighing no more than 1.62 ounces and having a core and cover, a mean outside diameter of between 1.73 inches and 1.75 inches, a cover thickness of 0.125 inches or greater and a cover hardness of Shore D60 or greater.

8 Claims, 1 Drawing Sheet

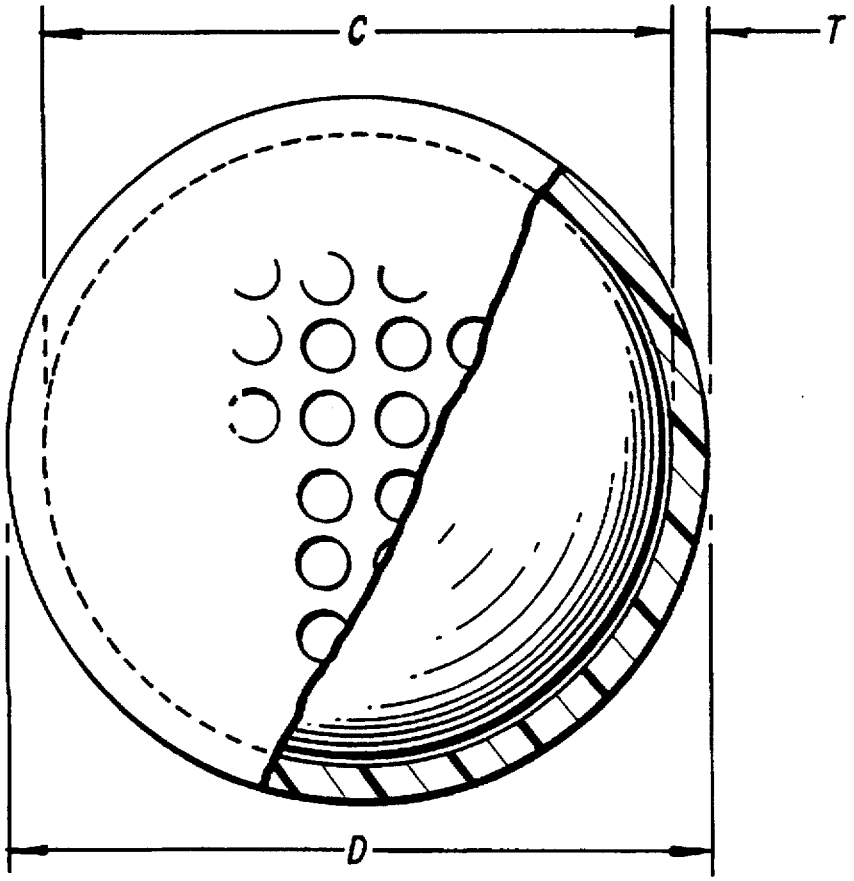
C
T
D

GOLF BALL

This is a continuation-in-part of U.S. patent application Ser. No. 08/530,851 filed Sep. 20, 1995 which is a division of U.S. patent application Ser. No. 08/171,956 filed Dec. 22, 1993, now U.S. Pat. No. 5,503,379 which is a continuation of U.S. patent application Ser. No. 8,198 filed Jan. 25, 1993, now abandoned.

This invention relates to golf balls. In particular, it relates to a two-piece golf ball having playability characteristics which are improved relative to state-of-the-art balls.

According to United States Golf Association (U.S.G.A.) rules, a golf ball may not have a weight in excess of 1.620 ounces or a diameter smaller than 1.680 inches. The initial velocity of U.S.G.A. "regulation" balls may not exceed 250 feet per second with a maximum tolerance of 2%. Initial velocity is measured on a standard machine kept by the U.S.G.A. A projection on a wheel rotating at a defined speed hits the test ball, and the length of time it takes the ball to traverse a set distance after impact is measured. U.S.G.A. regulations also require that a ball not travel a distance greater than 280 yards when hit by the U.S.G.A. outdoor driving machine under specified conditions. In addition to this specification, there is a tolerance plus 4% and a 2% tolerance for test error.

These specifications limit how far a golf ball will travel when hit in several ways. Increasing the weight of a golf ball tends to increase the distance it will travel and lower the trajectory. A ball having greater momentum is better able to overcome drag. Reducing the diameter of the ball also has the effect of increasing the distance it will travel when hit. This is believed to occur primarily because a smaller ball has a smaller projected area and, thus, a lower drag when traveling through the air. Increasing initial velocity increases the distance the ball will travel.

The foregoing generalizations hold when the effect of size, weight, or initial velocity is measured in isolation. Flight characteristics (influenced by dimple pattern and ball rotation properties), club head speed, launch angle, radius of gyration, and diverse other factors also influence the distance a ball will travel.

In the manufacture of top-grade golf balls for use by professional golfers and amateur golf enthusiasts, the distance a ball will travel when hit (hereinafter referred to as "distance") is an important design criterion. Since the U.S.G.A. rules were established, golf ball manufacturers have designed top-grade U.S.G.A. regulation balls to be as close to the maximum weight, minimum diameter, and maximum initial velocity as golf ball technology will permit. The distance a ball will travel when hit has, however, been improved by changes in raw materials, construction and by alteration in dimple configuration.

Golf balls not conforming to U.S.G.A. specifications in various respects have been made in the United States. Prior to the effective date of the U.S.G.A. rules, balls of various weights, diameters, and resiliencies were common. So-called "rabbit balls," which claim to exceed the U.S.G.A. initial velocity limitations, have also been offered for sale. Recently, oversized, overweight golf balls have been on sale for use as golf teaching aids (see U.S. Pat. No. 4,201,384 to Barber).

Oversized golf balls are also disclosed in New Zealand Patent 192,618 dated Jan. 1, 1980, issued to a predecessor of the present assignee. This patent discloses an oversized golf ball having a diameter between 1.700 and 1.730 inches and an oversized core of resilient material so as to increase the coefficient of restitution. Additionally, the patent discloses that the ball include a cover having a thickness less than the cover thickness of conventional balls.

The ball being manufactured under the name TOP-FLITE as set forth in the parent patent of the present application has a diameter of substantially 1.72 inches and a cover thickness of substantially 0.88 inches.

Golf balls made by Spalding in 1915 were of a diameter ranging from 1.630 inches. As the diameter of the ball increased, the weight of the ball also increased.

Golf balls known as the LYNX JUMBO were also produced and sold in October of 1979. This ball had a diameter of substantially 1.80 inches. This ball met with little or no commercial success.

Top-grade golf balls sold in the United States may be classified as one of two types: two-piece or three-piece. The two-piece ball, exemplified by the balls sold by Spalding Corporation under the trademark TOP-FLITE, consists of a solid polymeric core and a separately formed cover. The so-called three-piece balls, exemplified by the balls sold under the trademark TITLEIST by the Acushnet Company, consist of a liquid (e.g., TITLEIST TOUR 384) or solid (e.g., TITLEIST DT) center, elastomeric thread windings about the center, and a cover. Although the nature of the cover can, in certain instances, make a significant contribution to the overall coefficient of restitution and initial velocity of a ball (see, for example, U.S. Pat. No. 3,819,768 to Molitor), the initial velocity of two-piece and three-piece balls is determined mainly by the coefficient of restitution of the core. The coefficient of restitution of the core of wound balls can be controlled within limits by regulating the winding tension and the thread and center composition. With respect to two-piece balls, the coefficient of restitution of the core is a function of the properties of the elastomer composition from which it is made. Solid cores today are typically molded using polybutadiene elastomers mixed with acrylate or methacrylate metal salts. High-density fillers such as zinc oxide are included in the core material in order to achieve the maximum U.S.G.A. weight limit.

Improvements in cover and core material formulations and changes in dimple patterns have more or less continually improved golf ball distance for the last 20 years. Top-grade golf balls, however, must meet several other important design criteria. To successfully compete in today's golf ball market, a golf ball should be resistant to cutting and must be finished well; it should hold a line in putting and should have good click and feel. With a well-designed ball, experienced players, can better execute shots involving draw, fade, or abrupt stops, as the situation dictates.

SUMMARY OF THE INVENTION

The golf ball of the present invention provides an improvement over previously proposed oversized golf balls. The present ball, even though of a larger diameter of at least 1.73 inches, preferably uses substantially the same size core or smaller than a standard golf ball, with the difference in size being provided by additional thickness in the cover of the ball. The ball has a cover thickness of at least 0.125 inches, a cover hardness of Shore D 60 or greater and a weight no greater than 1.62 ounces.

BRIEF DESCRIPTION OF THE DRAWING

The single drawing FIGURE illustrates a partially sectioned view of the improved ball of the present invention.

DETAILED DESCRIPTION OF THE PREFERRED EMBODIMENT

The following description relates to the general construction of a two piece golf ball as shown in the drawing. The ball has an outside diameter D, a core diameter C and a cover thickness T. Thus, the outside diameter D is equal to C+2T.

The ball of the present invention has an outside diameter D of between 1.73 inches and 1.75 inches, and a cover thickness T between 0.125 inches and 0.145 inches. The diameter C of the core is dependent upon the selected outside diameter and cover thickness.

The golf ball presently manufactured under parent U.S. Pat. No. 5,273,287 is substantially 1.72 inches in diameter, weighs substantially 1.62 ounces and has a cover thickness of substantially 0.088 inches. The ball is available under the trademark Top-Flite Magna®. The following test results compared this ball with a ball having a diameter of substantially 1.74 inches and a cover thickness of substantially 0.135 inches. Both balls have the same basic dimple pattern which in these tests is a tri-dimple pattern having 422 dimples as shown and described in U.S. Pat. No. 5,273,287 relative to FIGS. 3 and 4 of that patent.

Test #1 - Distance
LAUNCH CONDITIONS

| Club Type | 5 Iron |
|---|---|
| Clubhead Speed (fps) | 123 |
| Launch Angle (deg) | 15.3 |
| Ball Speed (fps) | 167 |
| Spin Rate (rpm) | 5966 |

| Ball | Carry (yds) | Carry diff (yds) | Roll (yds) | Total (yds) | Total diff (yds) |
|---|---|---|---|---|---|
| TOP-FLITE 1.72 Magna | 163.0 | −0.8 | 3.8 | 166.8 | −1.6 |
| 1.74 Magna | 163.8 | −0.0 | 4.6 | 168.4 | 0.0 |

Test #2 - Distance
LAUNCH CONDITIONS

| Club Type | Driver |
|---|---|
| Clubhead Speed (fps) | 140 |
| Launch Angle (deg) | 9.2 |
| Ball Speed (fps) | 195 |
| Spin Rate (rpm) | 3133 |

| Ball | Carry (yds) | Carry diff (yds) | Roll (yds) | Total (yds) | Total diff (yds) |
|---|---|---|---|---|---|
| TOP-FLITE 1.72 Magna | 206.0 | 0.0 | 13.5 | 219.5 | 0.0 |
| 1.74 Magna | 201.9 | −4.1 | 16.4 | 218.3 | −1.2 |

Test #3 - Spin Test

| Miya Driving machine setup with TOP-FLITE Tour | 9 iron |
|---|---|
| Full face shot CHS approx. | 105. fps |

-continued

| Ball | L.A. (deg) | Ball Speed (fps) | Spin (rpm) | Moment of Inertia |
|---|---|---|---|---|
| TOP-FLITE 1.72 Magna | 32.4 | 110.7 | 7746 | 0.465 |
| 1.74 Magna | 32.9 | 110.2 | 7313 | 0.479 |

Test #3 shows that the 1.74 inch ball has a higher moment of inertia and, correspondingly, has a lower spin rate than the 1.72 inch ball.

Tests #1 and #2 show that the 1.74 inch ball is comparable in distance to the smaller ball and, in fact, a little longer in the five-iron test. This is remarkable in light of the anticipated increased drag the larger ball encounters.

Initial live play testing indicates that the 1.74 inch ball offers an easier ball to hit since it sits up higher in grass, gets up in the air easier and is more accurate (straighter) due to its lower spin rates and higher moment of inertia.

The above description and drawing are illustrative only since obvious modifications could be made without departing from the invention, the scope of which is to be limited only by the following claims.

We claim:

1. A golf ball of improved playing characteristics comprising a core and an outer cover;

said cover having a hardness of Shore D60 or greater;

said cover having a thickness of 0.125 inches or greater; and the outside diameter of said ball having a diameter between 1.73 and 1.75 inches.

2. The golf ball of claim 1, wherein said cover has a hardness of between Shore D60 and Shore D80 and said cover has a thickness of between 0.125 and 0.150 inches.

3. The golf ball of claim 1, wherein said cover hardness is between Shore D65 and Shore D75.

4. The golf ball of claim 1, wherein said cover hardness is between Shore D65 and Shore D 70.

5. The golf ball of claim 1, wherein said cover has a thickness between 0.125 and 0.184 inches.

6. The golf ball of claim 1, wherein said cover has a thickness of substantially 0.135 inches.

7. The golf ball of claim 1, wherein the outer diameter of said ball is substantially 1.74 inches.

8. The golf ball of claim 1, wherein the weight of the ball is no greater than 1.62 ounces.

* * * * *